United States Patent [19]

Friar et al.

[11] Patent Number: 5,054,224

[45] Date of Patent: Oct. 8, 1991

[54] APPARATUS AND METHOD FOR A COMPOSITE POLYMER RIFLING DISPOSABLE GUN TUBE

[75] Inventors: Glenn Friar, Clifton Park; Kevin Miner, Wateruliet; Christopher Rinaldi, Ballston Lake; David Wilson, Menands, all of N.Y.

[73] Assignee: The United States of America as represented by the Secretary of the Army, Washington, D.C.

[21] Appl. No.: 615,183

[22] Filed: Nov. 19, 1990

[51] Int. Cl.[5] ..... F41A 21/02

[52] U.S. Cl. ..... 42/076.02; 89/1.703; 89/1.816

[58] Field of Search ..... 42/76.02, 98; 89/1.7, 89/1.703, 1.816, 16

[56] References Cited

U.S. PATENT DOCUMENTS

| | | | |
|---|---|---|---|
| 2,956,479 | 10/1960 | Musser | 89/1.7 |
| 3,298,279 | 1/1967 | Barnet et al. | 42/76.02 |
| 3,517,585 | 6/1970 | Slade | 89/16 |
| 3,643,364 | 2/1972 | Koch | 42/78 |
| 4,153,282 | 5/1979 | Clodfelter | 89/1.816 |
| 4,435,455 | 3/1984 | Prewo et al. | 89/16 |
| 4,485,721 | 12/1984 | Shankhla et al. | 89/16 |
| 4,646,615 | 3/1987 | Gladstone et al. | 89/1.816 |
| 4,685,236 | 8/1987 | May | 42/76.02 |
| 4,729,806 | 3/1988 | Stein | 42/76.02 |
| 4,843,946 | 7/1989 | Gladstone et al. | 89/1.7 |

*Primary Examiner*—David H. Brown

*Attorney, Agent, or Firm*—Anthony T. Lane; Edward Goldberg; Michael C. Sachs

[57] ABSTRACT

An apparatus and method for producing a disposable composite laminate gun with polygon rifling and integrally fabricated conically shaped chamber section. A polygonal shaped barrel mandrel is joined with a radial segmented chamber mandrel, wound with alternate helical and hoop filament wraps, impregnated and cured to produce an inexpensive, light weight gun.

3 Claims, 2 Drawing Sheets

APPARATUS AND METHOD FOR A COMPOSITE POLYMER RIFLING DISPOSABLE GUN TUBE

GOVERNMENTAL INTEREST

The invention described herein may be manufactured, used and licensed by or for the Government for Governmental purposes without the payment to us of any royalty thereon.

BACKGROUND OF THE INVENTION

The present invention relates to an apparatus and method for a continuous filament composite polygon rifling disposable gun tube.

Various means have been used in the past to find an economical means of rifling large caliber composite gun tubes ever since composite materials were introduced into gun design. By definition in this application the term "composite" means a continuous filament reinforced plastic or metal constructed through the use of either filament winding, braiding resin transfer molding or fabric lay up. "Polygon Rifling" means a helix consisting of a closed figure composed of chords of a circle joined end to end.

One of the methods previously used to rifle a composite gun tube was to broach or machine grooves into a composite material with 3-dimensional high strength properties. Another prior art method used a metal liner with a composite overwrap for added strength properties. The problem with the use of 3-dimensional composite material and composite overwrapped liners was that they were prohibitively expensive as viable candidates when considering disposable weaponry. In addition both of the above prior art designs require extensive machine and assembly operations where as the polygon rifling of the present invention is fabricated in a one step operation. A further disadvantage of the use of prior art machined 3-dimensional composite material gun tubes is the possible micro-cracking damage to the matrix material. This damage frequently reduces the materials strength, stiffness and environmental properties.

The present invention is superior to the prior art polygon rifled gun tubes because composite polygon rifling makes it economically feasible to produce a lightweight disposable rifled launcher.

SUMMARY OF THE INVENTION

The present invention relates to an apparatus and method for producing a disposable continuous filament composite polygon rifling for a large caliber gun tube by a one step operation.

An object of the present invention is to provide for a economical means of rifling a gun tube.

Another object of the present invention is to provide for composite polygon rifling which makes it economicaly feasible to produce a disposable rifled launcher.

Another object of the present invention is to provide for composite polygon rifling which can utilize one of many simple manufacturing processes including filament winding, braiding, resin transfer molding, and fabric lay up.

A further object of the present invention is to provide for the use of composite material in the construction of a polygon rifled gun tube wherein specific constituents and or fiber angles may be selected in conjunction with a desired rifling configuration to produce an efficent and lightweight alternative to conventional gun tube materials.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DESCRIPTION OF THE PREFERRED EMBODIMENTS

Figure 1:
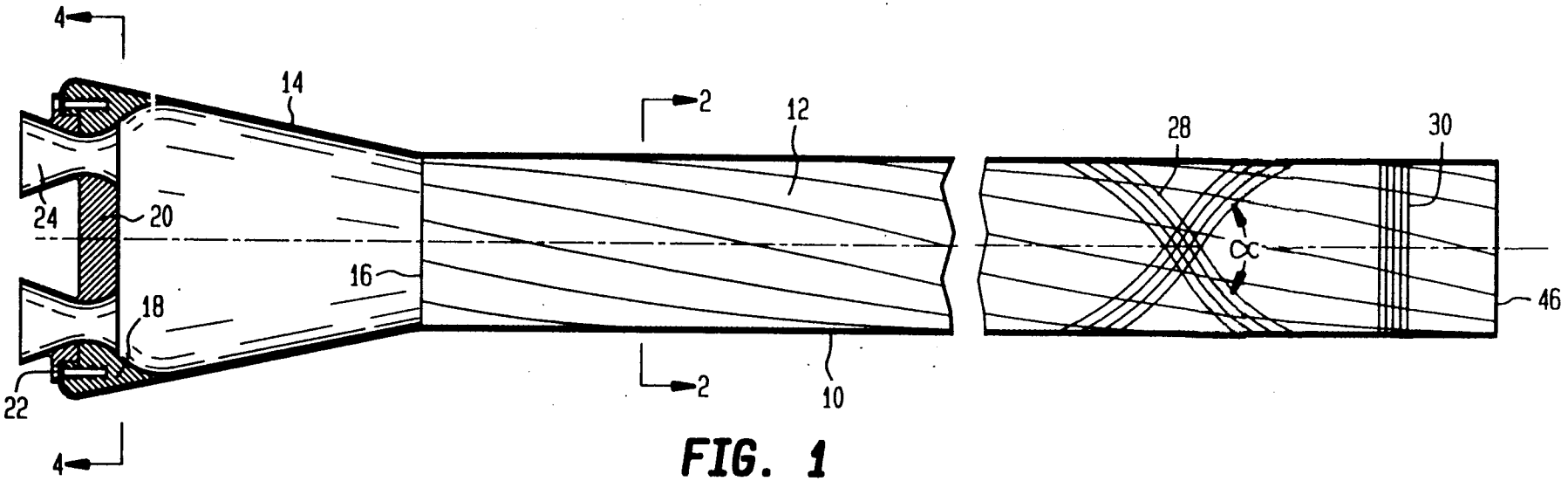
FIG. 1 is a diametral longitudinal cross section view of a launcher with a composite polygon rifled gun with an attached nozzle plate.
Figure 2:
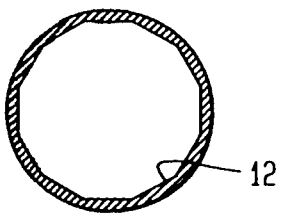
FIG. 2 is a cross sectional view of the gun tube taken along line 2—2 of FIG. 1.
Figure 4:
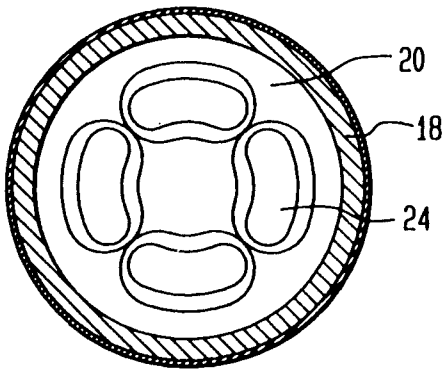
FIG. 4 is a rear view of the nozzle plate taken along line 4—4 of FIG. 1.
Figure 3:
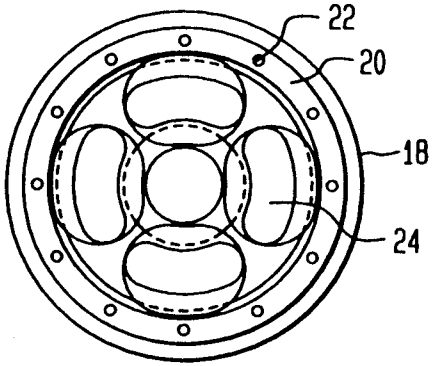
FIG. 3 is a front view of the nozzle plate of FIG. 1.

Referring now to FIGS. 1–4, the launcher includes a 32 inch barrel section 10 having 12 sided spiraled polygon rifling 12 which provides the required spin to a projectile not shown. The chamber 14 is integral with barrel 10, conically shaped, and approximately 12 inches in length expanding from a bore diameter of 105 mm at its front end 16 to approximately 8 inches at its rear seal end 18. A nozzle plate 20 is fixedly held to the nozzle seal end 18 of the chamber 14 by head cap screw 22. The nozzle plate 20 constitutes the rear of the launcher and contains 4 kidney-shaped exhaust ports 24. A projectile, not shown, is inserted from the rear of the launcher followed by a propellant charge, not shown. Nozzle plate 20 which is affixed to the nozzle seal 18 using 12 cap screws 22 passing through the laminate and threading into the ring-like nozzle seal 18. The barrel section 10 is formed using composite laminate capable of handling the stress due to internal pressure, longitudinal forces and torque generated during gun firing. Helical filament fiber type wraps 26 and 28 are wound, at a chosen angle $\alpha$, in conjunction with a 90° hoop filament type wrap 30. The hoop wrap 30 and the helical wraps 26 and 28 are used to contain the pressure load while the helical wraps 26 and 28 are used to contain the longitudinal and torque load. The helical angle $\alpha$ is chosen such that the resulting stress from the longitudinal and torque loads act in the direction of the helical fibers.

Figure 5:
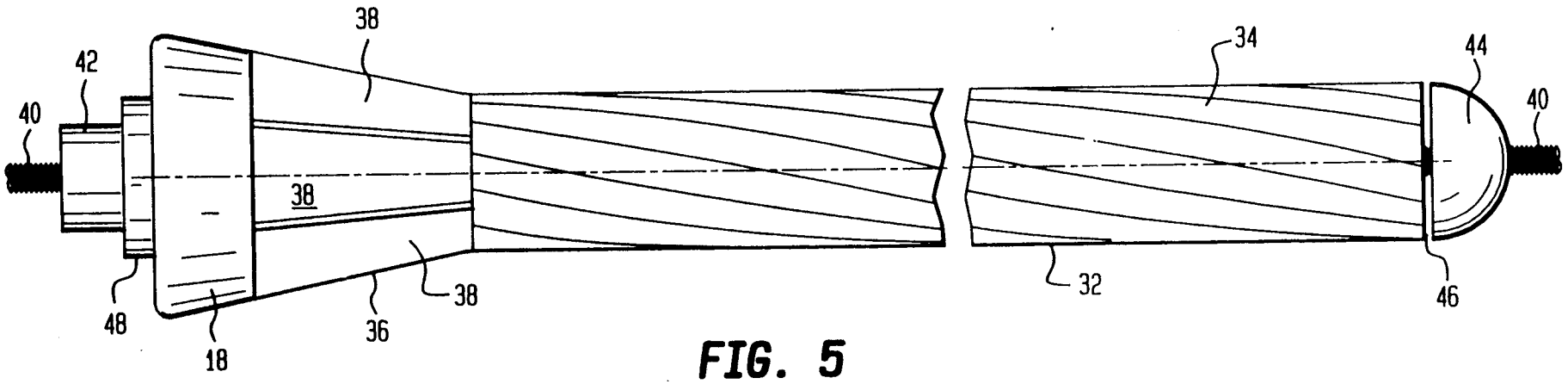
FIG. 5 is a planar view of an aluminum mandrel used in construction of the composite gun tube with integral conically shaped propellant chamber.

Reference now to FIG. 5, the method of fabrication includes filament winding preimpregnated graphite/epoxy material onto an aluminum mandrel followed by curing under heat and pressure, to be discussed in further detail hereinafter. The barrel section 32 of the mandrel has a 12 sided polygonal shape section 34 with a 150° twist over its length. The distance between the flats is 105 mm. The chamber portion 36 is composed of 7 radial segments 38 grouped around a central shaft, not shown, and axially affixed to the barrel mandrel 32 by a threaded rod 40 passing through its center. These radial segments 38 are held in place by the nozzle seal 18 which is an integral part of the launcher and is wound into the structure. An end cap 42 is used to hold the nozzle seal 18 onto the segments 38 during the fabrication. Both ends of the mandrel utilize a spherically shaped end dome 44, only one being shown, to facilitate the turn around of the filament during the winding process.

In operation, a laminate of composite material is used with a maximum pressure of 7000 psi and a torsional load of 100 pound feet. The laminate consists of 6 hoop wraps, 90° layers, and 4 helical wraps, +/−30° layers. Approximately 0.125 inch thick laminate is used consistently throughout the length of the launcher. The winding process uses a winding tension of about 5 pounds. The fiber path for the helical winding process starts at the end dome 44 at the muzzle end 46 and follows a constant 30° helical to the base of the chamber 36. As the fiber path progresses up the slope of the chamber 36, the helical angle increases to a 90° hoop wrap passing over the edge of the nozzle seal 18 to the boss 48 on the end cap 42 and returning to the muzzle end 46 by a similar path completing a complete circuit. This procedure is repeated many times while indexing the mandrel to develop the individual helical plies of the laminate. The hoop layers 30 similarly start at the muzzle end 46 and proceed towards the nozzle end 18 stopping at the rear portion of the chamber 14.

After winding the laminate is covered with a peal-ply fabric to produce a matte finish. This is followed by applying perforated halo hydro carbon release film which controls the amount of excess resin to be absorbed by the following 2 layers of peal-ply. A breather blanket and nylon bagging film is used to enclose the assembly and a vacuum is drawn to allow a hydrostatic atmospheric pressure to compact the laminate. The assembly is then placed into an oven for 2 hours at 350° to cure with no additional pressure being applied.

When the cure cycle is complete, the bagging material is removed. A lathe is then used to detach and discard the portion of the laminate extending over the muzzle and dome 44. Removing the end cap 48 and the central shaft 42 reveals the chamber segments 38 which are collapsed and withdrawn leaving the chamber 14 void. The barrel mandrel 32 can then be removed by sliding it in either direction.

As mentioned earlier the nozzle seal 18 is an integral part of the structure, being part of the mandrel of FIG. 5 it is wound in during the fabrication stage. The nozzle plate 20 is mated with the nozzle seal 18 and affixed thereto with socket head cap screws 22. The portion of the laminate which is sandwiched between the nozzle plate 20 and the nozzle seal 18 is of a precise thickness and is controlled during the winding stage just prior to bagging and curing. A plate, not shown, is slid over the mandrel's end cap 42 and bolted into position compressing the still soft prepreg material to the proper thickness and providing a flat molding surface thereby eliminating the need for an additional maching operation.

An alternative fabrication technique utilizes a 144 carrier braider. A 6 layer triaxial braid containing 72 0° fiber yarns and 144 55° fiber yarns developing a laminate thickness of approximately 0.2 inches was braided upon the same filament winding mandrel of FIG. 5. Dry yarns with the resin brushed on was utilized as well as an automatic resin applicator system which precisely controls the resin volume ratio. After braiding, the assembly is slowly revolved and gelled using heat lamps. This step is then followed by curing without pressure in an oven. Using the resin applicator produces a better launcher faster and easier although the setup and clean up time is longer.

The foregoing disclosure and drawings are merely illustrative of the principles of this invention and are not to be interpreted in a limiting sense. We wish it to be understood that we do not desire to be limited to the exact details of construction shown and process described for obvious modifications will occur to a person skilled in the art.

What is claimed is:

1. A disposable gun which comprises:

composite polygon rifled barrel means for generating projectile spin, said barrel tube section having multi-sided polygon rifling therein, said section further comprising:

a first composite helical wrap;

a second composite helical wrap having an angle $\alpha$ with respect to said first composite helical wrap;

a composite 90° hoop wrap operatively wound on top of said helical wraps; and said disposable gun further comprising:

composite chamber means integrally connected with said barrel means for holding a propellant charge therein;

a ring seal member operatively attached to the rear end of said chamber means;

nozzle means attached to said ring seal for exhausting propellant gases, giving thrust and providing spin to a projectile operatively disposed in said chamber means, said nozzle means comprising:

a circularly shaped nozzle plate removably attached to said ring seal member;

a plurality of nozzles operatively disposed in said nozzle plate for venting gases from said chamber means; and a plurality of cap screws for holding said nozzle plate fixedly to said chamber means.

2. A gun as in claim 1 wherein said gun comprises a composite laminate structure including filament reinforced plastic or metal material.

3. A gun as in claim 2 wherein said material includes preimpregnated graphite epoxy material.

* * * * *